United States Patent [19]

Johnson, Jr.

[11] 4,322,176

[45] Mar. 30, 1982

[54] TUBULAR BEAM JOINT

[75] Inventor: Alfred L. Johnson, Jr., Manhattan Beach, Calif.

[73] Assignee: Lajet Energy Company, Abilene, Tex.

[21] Appl. No.: 149,756

[22] Filed: May 14, 1980

[51] Int. Cl.[3] ..... F16D 1/00; F16D 3/00

[52] U.S. Cl. ..... 403/219; 52/81; 52/648; 403/170; 403/176

[58] Field of Search ..... 52/81, 648, 86; 403/170, 171, 172, 173, 176, 178, 217, 219

[56] References Cited

U.S. PATENT DOCUMENTS

| | | | |
|---|---|---|---|
| 2,658,776 | 11/1953 | Wilcox | 287/54 |
| 2,964,147 | 12/1960 | Fentiman | 189/34 |
| 2,976,968 | 3/1961 | Fentiman | 189/34 |
| 3,270,478 | 9/1966 | Attwood | 52/648 |
| 3,309,121 | 3/1967 | Fentiman | 287/189.36 |
| 3,323,820 | 6/1967 | Braccini | 287/189.36 |
| 3,443,348 | 5/1969 | Papayoti | 52/299 |
| 3,485,005 | 12/1969 | Kutchai | 52/643 |
| 3,914,063 | 10/1975 | Papayoti | 403/406 |
| 3,918,233 | 11/1975 | Simpson | 52/747 |

FOREIGN PATENT DOCUMENTS

| | | | |
|---|---|---|---|
| 171850 | 7/1952 | Austria | 403/219 |
| 850946 | 1/1953 | Fed. Rep. of Germany | 403/217 |
| 2444612 | 4/1976 | Fed. Rep. of Germany . | |
| 682854 | 6/1930 | France | 403/219 |
| 581277 | 1/1962 | Italy | 403/217 |

*Primary Examiner*—Wayne L. Shedd

*Attorney, Agent, or Firm*—Roylance, Abrams, Berdo & Farley

[57] ABSTRACT

A joint for connecting tubular beams comprising two caps receiving deformed end portions of the beams therebetween. Each cap has a tapering tubular portion in contact with the end portions, each end portion having first and second outwardly diverging opposed faces and third and fourth inwardly converging opposed faces. The outer perimeter of the end portion is greater than the perimeter of an opening defined on the top and bottom by the two caps and on the sides by adjacent beams, so each end portion is highly resistant to forces tending to pull it from between the caps and must be mechanically deformed before it will be pulled through the opening.

19 Claims, 28 Drawing Figures

TUBULAR BEAM JOINT

BACKGROUND OF THE INVENTION

Skeleton frameworks in the form of trusses, space frames and lattice-works are well known in the art for supporting various objects or for forming load bearing walls for building structures. Unfortunately, many of these prior art strcutures are very expensive to mass produce since the joints coupling the elongated beams or struts forming the structure have traditionally been very complicated and require extensive machining. In addition, many of these prior art structures are very difficult to assemble and are heavy.

Moreover, many of the prior art structures utilize joints which do not adequately rigidly couple the elongated members forming the structure which can result in failure after initial erection. Many of these prior art structures do not utilize tubular elongated members but instead utilize solid rods which are very expensive to make, are very heavy and do not have great resistance to bending.

Such prior art structures are disclosed in the following U.S. Pat. Nos. 2,964,147, issued to Fentiman on Dec. 13, 1960; 2,976,968, issued to Fentiman on Mar. 28, 1961; 3,270,478, issued to Attwood on Sept. 6, 1966; 3,443,348, issued to Papayoti on May 13, 1969; and 3,918,233, issued to Simpson on Nov. 11, 1975. In addition such prior art structures are disclosed in French Pat. No. 682,854, issued to Doornbos et al on June 3, 1930 and Italian Pat. No. 581,277, issued to Industria Officine Magliana on Aug. 25, 1958.

SUMMARY OF THE INVENTION

Accordingly, it is a primary object of the present invention to provide a tubular beam joint which is inexpensive to manufacture, easy to assemble, light and sufficiently rigid to withstand extensive bending moments.

Another object of the present invention is to provide such a joint which utilizes tubular beams for added resistance to bending.

Another object of the present invention is to provide a joint which can be manufactured with little machining of parts.

Another object of the present invention is to provide such a joint which can be assembled merely through the use of a single bolt and nut fastener for each joint.

The foregoing objects are basically attained by providing a joint for connecting a tubular beam, the combination comprising a housing having two opposed converging walls and two opposed diverging walls, the walls defining an opening in the housing; and a hollow tubular beam having a main portion and a deformed end portion, the end portion being received in the housing and the main portion extending from the opening, the end portion comprising first and second outwardly diverging opposed faces contacting, respectively, the opposed diverging walls, and third and fourth inwardly converging opposed faces contacting, respectively, the opposed diverging walls, the end portion having a perimeter which is greater than the perimeter of the opening.

Advantageously, six beams having 60° converging angles on their side converging faces can be arranged in a circular array with a top and a bottom cap coupling them together. In this case, the caps form the opposed diverging walls and the adjacent beam end portion converging faces form the converging walls to define the housing receiving the end portion. The opening in this instant is between the caps and between the main portions of the beams on adjacent sides.

Because the beams are tubular, there is extremely good resistance against bending in a frame formed thereby. Moreover, by making the end portions with a perimeter greater than the opening from which the main portion extends, the end portions of the beams must be mechanically deformed before they will be pulled from their connection with the first and second caps in each joint. Thus, an extremely rigid and long lasting joint is formed.

Each joint is simply assembled by means of a single bolt and nut fastener coupling the first and second caps together with the end portions of the tubular beams therein. This joint is also very inexpensive to produce since little machining is necessary on the various parts forming the joint.

Other objects, advantages and salient features of the present invention will become apparent from the following detailed description, which, taken in conjunction with the annexed drawings, discloses preferred embodiments of the present invention.

DRAWINGS

Referring now to the drawings which form a part of this original disclosure:

DETAILED DESCRIPTION OF THE INVENTION

Figure 3:
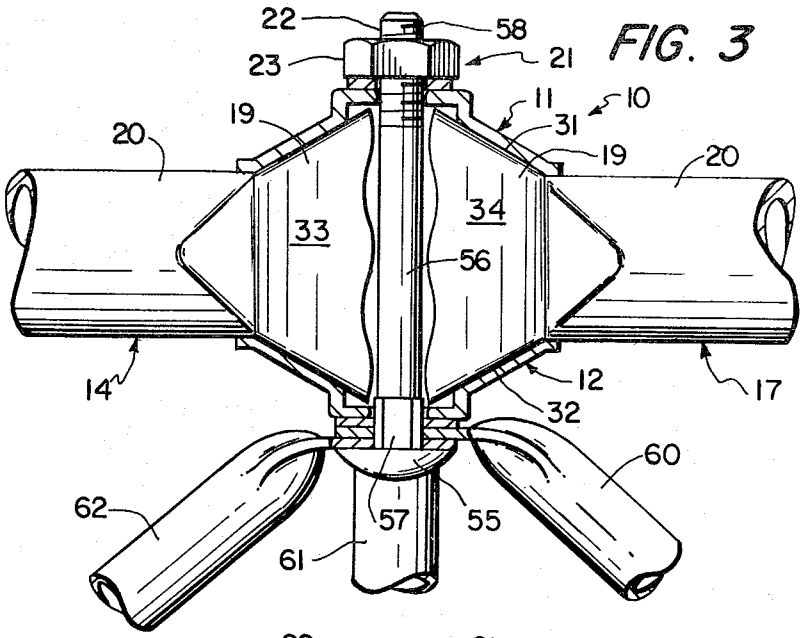
FIG. 3 is a side view in section of the joint in accordance with the present invention taken along line 3—3 in FIG. 1.

Referring now to FIGS. 1-4, the joint 10 in accordance with the present invention is shown comprising a first cap 11, a second cap 12, six tubular beams 13-18, each beam having an end portion 19 and a main portion 20, and a fastener 21 formed from a bolt 22 and a nut 23. The end portions 19 of each tubular beam are rigidly received between the opposed first and second caps 11 and 12, which are secured together by means of fastener 21.

Figure 12:
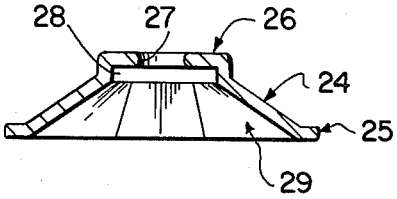
FIG. 12 is a longitudinal vertical section taken along line 12—12 in FIG. 1 of the cap.
Figure 13:
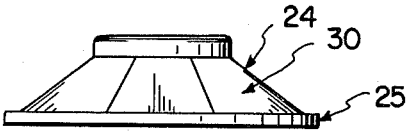
FIG. 13 is a side elevational view of the cap shown in FIG. 1.

As seen in FIGS. 1, 3, 4, 12 and 13, the first and second caps 11 and 12 are mirror images, each comprising a tapering tubular portion 24, an annular flange 25 at the larger diameter of the tubular portion, and a closed end 26 at the smaller end of the tubular portion. The closed end is in the nature of a disc and has a central bore 27 therein. As seen in FIG. 12, a short cylindrical portion 28 is located in the tapering tubular portion 24 just below the closed end 26. The tapering tubular portion 24 has an internal surface 29 and an external surface 30 both of which are in the form of a six-sided frustum comprised of six planar, trapezoidal sections extending from the annular flange 25 up to the cylindrical portion 28. If desired, these internal and external surfaces could be frustoconical.

Figure 5:
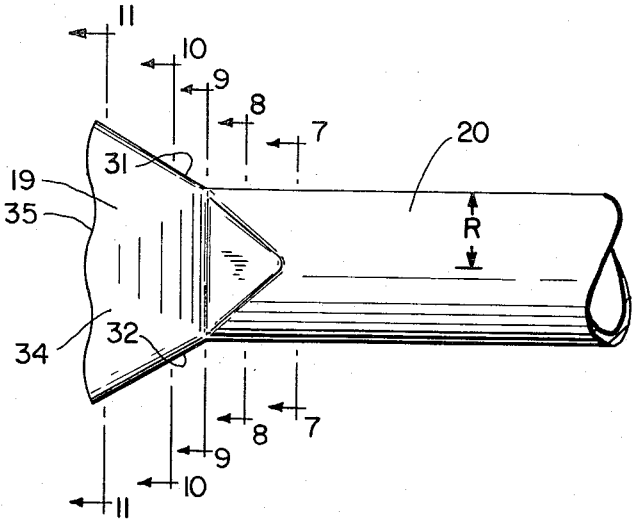
FIG. 5 is a side elevational view of a tubular beam utilized in the present invention.

As seen in FIGS. 5-11, each tubular beam is completely hollow throughout its length including the end portion 19 and the main portion 20 for each beam. Preferably, the beam is formed of steel and the main portion of each beam is cylindrical, with a cylindrical inner surface and cylindrical outer surface, the radius of the main portion 20 as seen in FIG. 5 to the external surface thereof having a length R.

Each end portion 19 is integrally formed with the main portion 20 on each beam and is deformed into the configuration shown in FIGS. 5-11. Each end portion comprises a first face 31, a second face 32, a third face 33 and a fourth face 34 as seen in FIGS. 5, 6, 7 and 23.

The first and second faces 31 and 32 are outwardly diverging and opposed from each other and are each substantially planar and trapezoidal. The larger base of each trapezoidal face is adjacent the connection of the end portion 19 with the main portion 20.

The third and fourth faces 33 and 34 are inwardly converging and opposed and are each planar and trapezoidal, the larger base of the trapezoidal face being located at the distal end 35 of the end portion 19.

Figure 2:
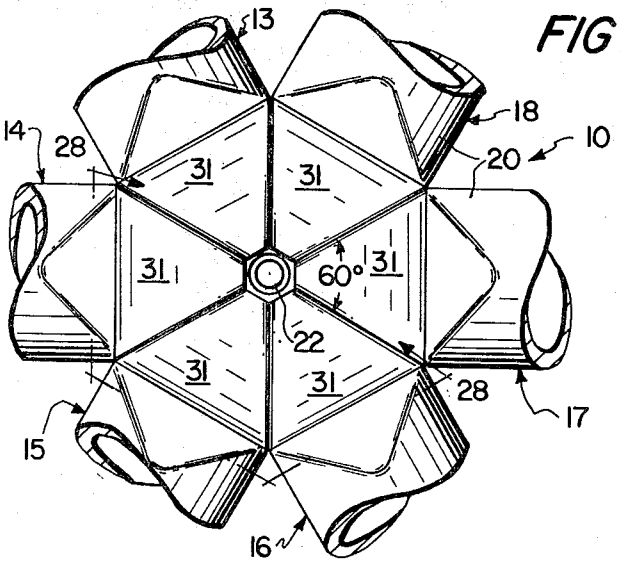
FIG. 2 is a top plan view of the joint shown in FIG. 1 with the top cap removed therefrom.
Figure 6:
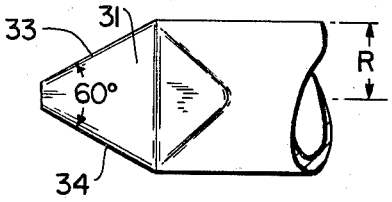
FIG. 6 is a top plan view of the tubular beam shown in FIG. 5.

As seen in FIGS. 2 and 6, the third and fourth faces converge at an angle of about 60° so that as seen in FIG. 2 all six of the tubular beams are in a circular contacting array fully including 360°.

As seen in FIG. 3, the angle of the taper of tubular portion 24 substantially coincides with the outwardly diverging angle of the first and second opposed faces 31 and 32 on each end portion 19.

As seen from the progression of the cross-sectional views in FIGS. 7-11, the cross section of the main portion 20 of each tubular beam changes as it approaches the beginning of the end portion 19 and the end portion 19 has a changing cross section from its beginning to the distal end 35 thereof.

Figure 7:
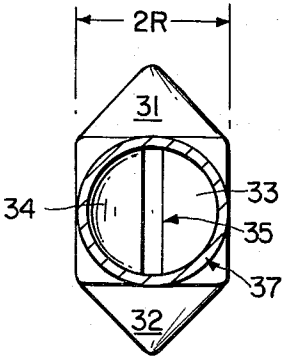
FIG. 7 is a sectional view of the beam taken along line 7—7 in FIG. 5.

As seen in FIGS. 5 and 7, the cross section 37 of the main portion 20 is cylindrical with an outer diameter of the outer surface thereof being 2R.

Figure 8:
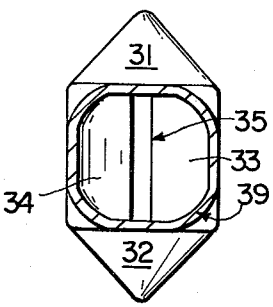
FIG. 8 is a sectional view of the beam taken along line 8—8 in FIG. 5.

From this cylindrical cross section 37, the cross section of the main portion 20 changes as it approaches the end portion 19 and as seen in FIG. 8 it comprises a cross section 39 comprised of four equally spaced planar portions and four curvilinear portions interposed therebetween.

Figure 9:
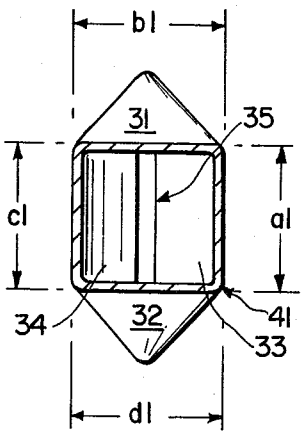
FIG. 9 is a sectional view of the beam taken along line 9—9 in FIG. 5.

As seen in FIG. 9, at the end of the main portion 20 and the beginning of the end portion 19 the cross section 41 is square, each side of the square having a length equal to 2R, which is the same as the outer diameter of the main portion 20. The perimeter at this cross section is thus 8R, and is also shown as a1+b1+c1+d1, which is the sum of the length of each side of the square.

Figure 11:
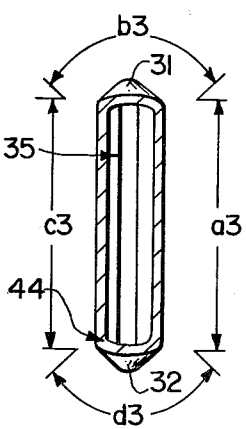
FIG. 11 is a sectional elevational view of the beam taken along line 11—11 in FIG. 5.
Figure 10:
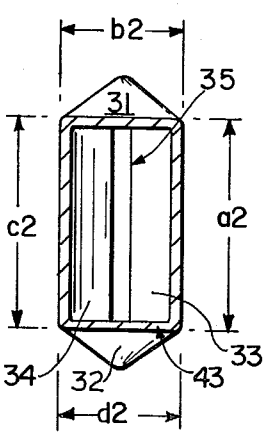
FIG. 10 is a sectional view of the beam taken along line 10—10 in FIG. 5.

As seen in FIG. 10, as the end portion 19 extends towards the distal end 35 there is a rectangular cross section 43 and as seen in FIG. 11 a cross section 44 which is comprised of two planar parallel sides and two curvilinear portions at the top and bottom thereof.

The rectangular cross section 43 has a perimeter equal to a2+b2+c2+d2, which is the sum of the length of each side of the rectangle. This perimeter is greater than the perimeter of cross section 33. That is, a2+b2+c2+d2 is greater than a1+b1+c1+d1. This is accomplished by stretching the end portion 19 during its construction, as will be described in more detail hereinafter regarding FIGS. 14-25.

In a similar manner, the cross section 44 has a perimeter equal to a3+b3+c3+d3 which is greater than a2+b2+c2+d2 and, therefore greater than a1+b1+c1+d1. As seen in FIG. 11, b3 and d3 represent the length of the curvilinear parts of cross section 44 and a3 and c3 the length of the straight sides.

Figure 23:
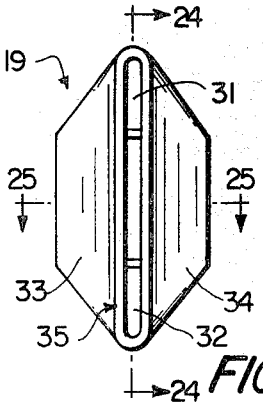
FIG. 23 is an end view of the beam after the fourth and final deformation.

The final cross section of the end portion at the distal end 35 is seen in FIG. 23, this distal end cross section having a perimeter greater than that of cross section 44.

Thus, the perimeter of the end portion 19 is greater than the perimeter of the main portion and continually increases as it extends from the main portion 20 to its distal end 35.

Figure 1:
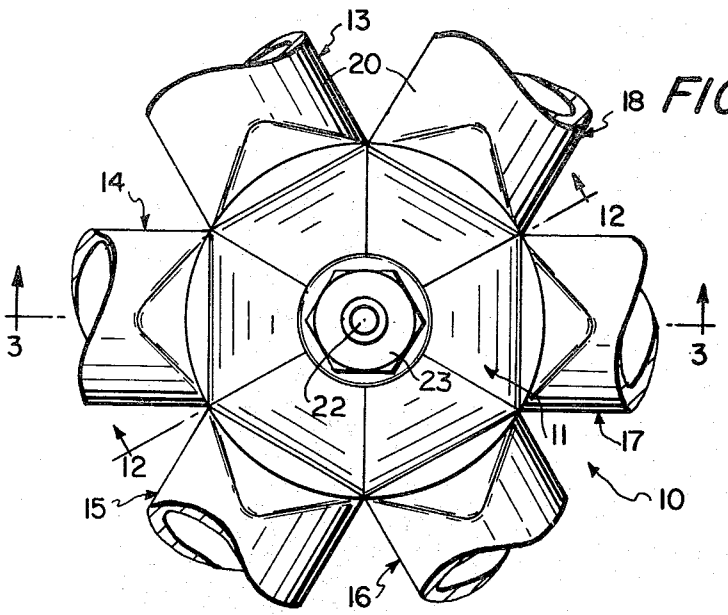
FIG. 1 is a top plan view of the joint in accordance with the present invention.

By such a construction, each end portion 19 of each of the beams 13-18 must be mechanically deformed, i.e., it must buckle, before it can be pulled from the connection with caps 11 and 12 as seen in FIGS. 1 and 3. This is because the convergent side faces 33 and 34 contact adjacent side faces of the other beam end portions on the sides and the divergent top and bottom faces 31 and 32 contact the tubular portions of caps 11 and 12 on the top and bottom. Thus, if a force acts on a beam tending to pull the beam from between the caps and the adjacent beams, this force will be opposed by such contact. The only way to pull the beam out from this contact is to deform the beam by buckling the end portion.

Figure 28:
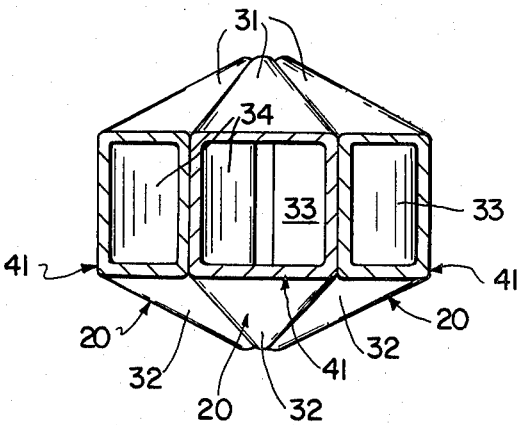
FIG. 28 is a vertical sectional view taken along line 28—28 in FIG. 2 of three contacting end portions.

In this regard, each beam end portion is basically received in a housing including a socket which is defined by two opposed diverging walls on the top and bottom formed by the tubular portions of the two caps 11 and 12 (see FIG. 3) and by two opposed converging walls on adjacent sides formed by the adjacent converging side walls 33 and 34 on the two adjacent beam end portions in the circular array of six beams (see FIG. 2). These adjacent beams and the caps define an opening which receives the square cross section 41 of each beam (see FIG. 28). Each end portion begins at this cross section 41 and has a perimeter greater than the perimeter of this opening, which also increases continually from that cross section to the distal end 35. The end portion perimeter is thus also greater than the maximum perimeter of the main portion at cross section 41, which perimeter is 8R, and greater than the perimeter of the main portion along its undeformed length, which is $\pi 2R$.

The deformation steps used to construct the end portion 19 of each beam seen in FIGS. 1–11 are illustrated in FIGS. 14–25.

Figure 14:
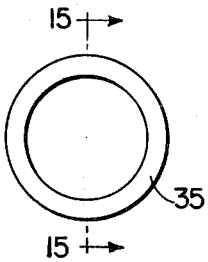
FIG. 14 is an end view of an undeformed tubular beam for use in the present invention.
Figure 15:
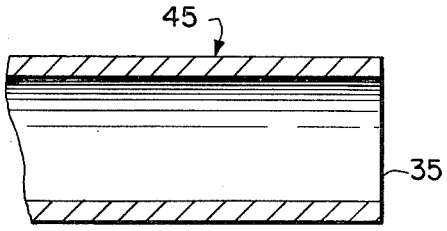
FIG. 15 is a vertical longitudinal sectional view of the tubular beam shown in FIG. 14 taken along lines 15—15 in FIG. 14.

FIGS. 14 and 15 show a cylindrical tubular beam 45 which is undeformed.

Figure 16:
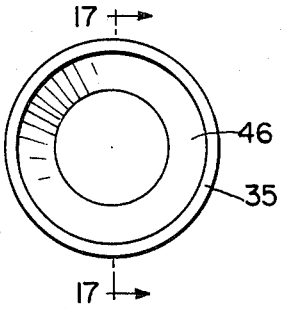
FIG. 16 is an end view of the tubular beam after a first deformation.
Figure 17:
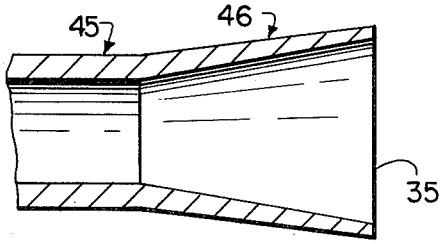
FIG. 17 is a vertical longitudinal sectional view of the beam taken along line 17—17 in FIG. 16.

In the first deforming step, a conical die is introduced into distal end 35 of the beam 45 to form a frusto-conical end portion 46 having a reducing thickness towards the distal end 35, as seen in FIGS. 16 and 17. This initial step outwardly stretches the end portion assuring that its perimeter will be greater than the perimeter of the main portion.

Figure 18:
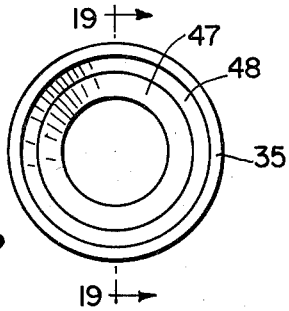
FIG. 18 is an end view of the beam after a second deformation.
Figure 19:
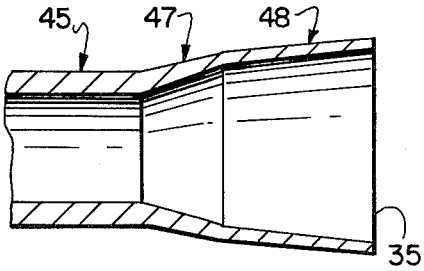
FIG. 19 is a vertical longitudinal sectional view of the beam taken along line 19—19 in FIG. 18.

In the second deforming step, a compound frustoconical die is introduced into distal end 35 to form a compound frustoconical configuration comprising frustoconical portion 47 and frustoconical portion 48, portion 48 having a larger angle of conical taper than portion 47. Portion 48 opens at the distal end 35 of the beam 45, as seen in FIGS. 18 and 19.

Figure 20:
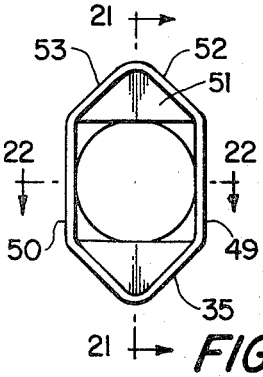
FIG. 20 is an end view of the beam after a third deformation.
Figure 21:
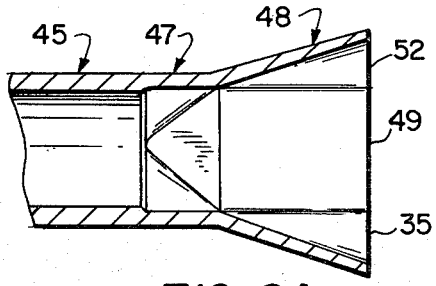
FIG. 21 is a vertical longitudinal sectional view of the beam taken along line 21—21 in FIG. 20.
Figure 22:
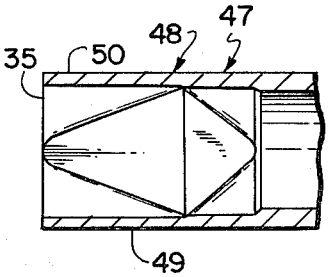
FIG. 22 is a horizontal longitudinal sectional view of the beam taken along line 22—22 in FIG. 20.

In the third deforming step, a die is introduced into distal end 35 which makes portion 47 assume a square cross section at the intersection with portion 48 as seen in FIGS. 20–22 (this is the same cross section seen in FIG. 9 and described above). In addition, portion 48 has planar sides 49, 50 and a top and bottom each formed by three triangles including an iscoseles triangle 51 in the middle with two right triangles 52 and 53 on the sides, the hypotenuse of each right triangle coinciding with the equal sides of the iscoseles triangle. As seen in FIGS. 20–22, the right triangles slope away from the plane of the isoceles triangle and meet with the edges of the sides 49 and 50.

In the fourth and final deforming step, a die is introduced into distal end 35, with portions contacting the outer surfaces of sides 49 and 50, to vertically stretch portion 48 to a larger vertical height and to converge sides 49 and 50 inwardly.

Figure 24:
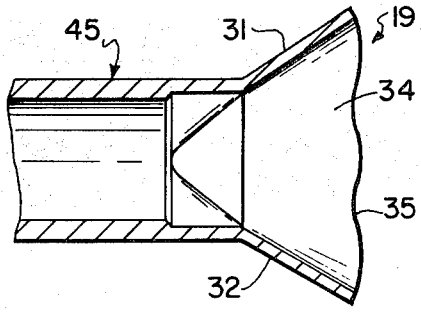
FIG. 24 is a vertical longitudinal sectional view of the beam taken along line 24—24 in FIG. 23.
Figure 25:
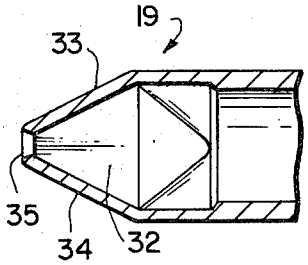
FIG. 25 is a horizontal longitudinal sectional view of the beam taken along line 25—25 in FIG. 23.

In the resulting structure shown in FIGS. 23–25, as well as FIGS. 5 and 6, the end portion 19 has the trapezoidal, planar converging side faces 33 and 34 and trapezoidal, planar diverging top and bottom faces 31 and 32.

Trigometric Relationship Of The End Portion

As seen in FIGS. 14–25, the end portion 19 is constructed by deforming steps so that the outer perimeter from cross section 41 (seen in FIG. 9) to the distal end 35 continually increases.

Figure 26:
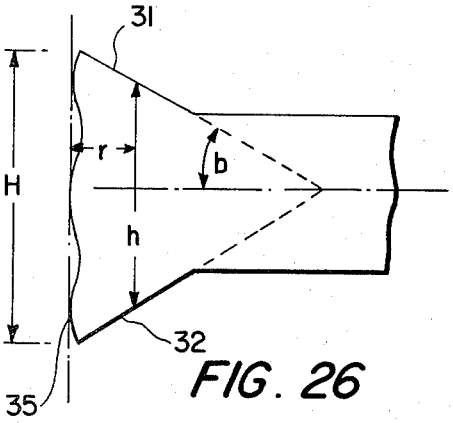
FIG. 26 is a diagramatic side view of the fully deformed beam.
Figure 27:
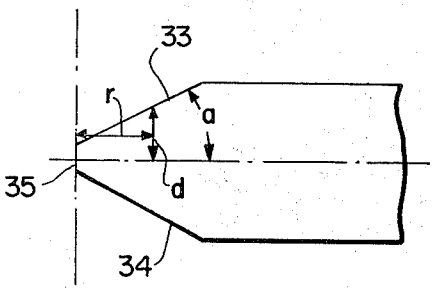
FIG. 27 is a diagramatic top view of the fully deformed beam.

Another way of defining and showing this configuration is set forth in FIGS. 26 and 27.

As seen in FIG. 26, the distance between diverging faces 31 and 32 at the distal end 35 is represented by reference character H and the distance at any place between the distal end 35 and the beginning of these faces is represented by reference character h. One-half the included divergent angle between faces 31 and 32 is designated b and the distance from the distal end 35 to any desired distance h is represented by r.

Thus, distance h can be calculated as:

$$h=H-2r\tan b$$

Similarly, regarding FIG. 27, one-half the included convergent angle between faces 33 and 34 is designated a and one-half the distance between these faces, at any distance r from distal end 35, is designated d.

Thus, the distance d can be calculated as $$d=r\tan a$$

The outer perimeter P of the end portion 19 comprised of faces 31, 32, 33 and 34 can then be calculated as a function of r as:

$$P(r)=4d+2h$$

And this becomes:

$$P(r)=4r\tan a+2H-4r\tan b$$

The rate of change of this perimeter P with respect to r is:

$$(dp/dr)=4\tan a-4\tan b$$

Since it is desired to have the perimeter P increase as r gets smaller or decrease as r gets larger, i.e., the perimeter decreases from the distal end 35 to the beginning of the end portion at cross section 41 in FIG. 9, then:

$$(dp/dr)<0$$

Therefore:

$$4(\tan a-4\tan b)<0$$

$$\tan a-\tan b<0$$

$$b>\arctan\tan a$$

$$b>a$$

Thus, to provide the desired result of an increasing perimeter of the end portion 19, it is preferable to have the included divergent angle $2b$ between faces 31 and 32 greater than the included convergent angle $2a$ between faces 33 and 34, which is how the end portion is formed as seen in FIGS. 14–25.

Referring again to FIGS. 1–4, the bolt 22 has an enlarged head 55 and a shaft 56 extending therefrom, the shaft having a hexagonal portion 57 adjacent head 55 and an externally threaded portion 58 at the distal end, receiving the internally threaded nut 23 thereon. The bolt 22 is received in the central bores 27 in the first and second caps 11 and 12, as most clearly seen in FIG. 3.

Figure 4:
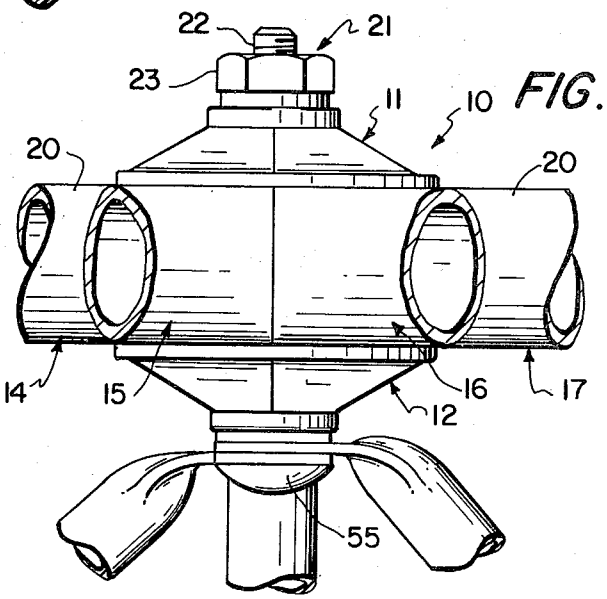
FIG. 4 is a side view of the joint in accordance with the present invention.

As seen in FIGS. 3 and 4, diagonal struts 60, 61 and 62 are formed as cylindrical tubes with crushed ends which are bent and which have hexagonal bores for reception of the hexagonal portion 57 in bolt 22. By using these struts a multiplane space frame can be formed.

While various advantageous embodiments have been chosen to illustrate the invention, it will be understood by those skilled in the art that various changes and modifications can be made therein without departing from the scope of the invention as defined in the appended claims.

What is claimed is:

1. A joint for connecting a tubular beam to a housing, the combination comprising:

a housing including a socket having two opposed converging walls and two opposed diverging walls, said walls defining an opening in said housing; and a hollow tubular beam having a main portion and a deformed end portion, said main portion and end portion being formed from a single piece of material, said end portion being received in said housing socket and said main portion extending from said opening, said end portion comprising:

first and second outwardly diverging opposed faces contacting, respectively, said opposed diverging walls in said socket, and third and fourth inwardly converging opposed faces contacting, respectively, said opposed converging walls in said socket, said end portion having a perimeter which is greater than the perimeter of said opening, said end portion having a wall thickness that is less than the wall thickness of said main portion.

2. A joint according to claim 1, wherein said end portion perimeter continually increases from the beginning thereof to the distal end thereof.

3. A joint according to claim 1, wherein the divergent angle included between said first and second diverging faces is greater than the convergent angle included between said third and fourth converging faces.

4. A joint according to claim 1, wherein said end portion has a square outer perimeter at the beginning thereof.

5. A joint according to claim 4, wherein said main portion has a cylindrical outer surface, said outer surface having a diameter substantially equal to a side of said end portion square outer perimeter.

6. A joint according to claim 1, wherein said first and second outwardly diverging opposed faces are substantially planar.

7. A joint according to claim 1, wherein said third and fourth inwardly converging opposed faces are substantially planar.

8. A joint for connecting a plurality of beams, the combination comprising:

first and second caps, each cap having a tapering tubular portion with a closed end, said closed end having a central bore therein;

a plurality of beams, each beam being tubular and comprising a main portion and an end portion formed from a single piece of material, the end portion of each beam being received between said caps in said tapering tubular portion; and a fastener received in said central bores and rigidly coupling said end portions between said caps, each of said end portions comprising:

first and second outwardly diverging opposed faces contacting the tubular portions of said caps, and third and fourth inwardly converging opposed faces contacting the inwardly converging opposed faces of adjacent end portions, each of said end portions having a perimeter which is greater than the perimeter of each of the associated main portions, each of said end portions having a wall thickness that is less than the wall thickness of the associated main portion.

9. A joint according to claim 8, wherein each of said tapering tubular portions has a plurality of planar faces in contact with said first and second opposed faces of said end portions.

10. A joint according to claim 9, wherein each of said planar faces is substantially trapezoidal.

11. A joint according to claim 8, wherein each of said tapering tubular portions has an interior surface in the form of a frustum.

12. A joint according to claim 8, wherein each of said main portions is cylindrical.

13. A joint according to claim 12, wherein each of said end portions has a substantially square cross section at the beginning thereof adjacent each of said main portions.

14. A joint according to claim 13, wherein a side of said square cross section has an outer dimension substantially equal to the outer diameter of said cylindrical main portion.

15. A joint according to claim 13, wherein intermediate the distal end of each of said end portions and said square cross section, each of said end portions has a substantially rectangular cross section.

16. A joint according to claim 8, wherein each of said third and fourth faces is substantially planar and substantially trapezoidal, the larger base of each trapezoidal face being at the distal end of each end portion.

17. A joint according to claim 8, wherein each of said first and second faces is trapezoidal having the larger base thereof at the beginning of each end portion adjacent each main portion.

18. A joint according to claim 8, wherein said plurality of beams comprises six beams, each of said end portions third and fourth faces converging at an angle of about 60°.

19. A joint for connecting a tubular beam to a housing, the combination comprising:

a housing including a socket having two opposed converging walls and two opposed diverging walls, said walls defining an opening in said housing; and a hollow tubular beam having a main portion and a deformed end portion, said main portion and end portion being formed from a single piece of material, said end portion being received in said housing socket and said main portion extending from said opening, said end portion comprising:

first and second outwardly diverging opposed faces contacting, respectively, said opposed diverging walls in said socket, and third and fourth inwardly converging opposed faces contacting, respectively, said opposed converging walls in said socket, said end portion having a perimeter which is greater than the perimeter of said opening, said end portion including an area with a substantially square cross section having an outer periphery no less than the outer periphery of said main portion, said main portion being substantially circular in cross section and merging into said square cross sectional area in said end portion.

* * * * *

UNITED STATES PATENT AND TRADEMARK OFFICE

CERTIFICATE OF CORRECTION

PATENT NO. : 4,322,176

DATED : March 30, 1982

INVENTOR(S) : Alfred L. Johnson, Jr.

It is certified that error appears in the above-identified patent and that said Letters Patent are hereby corrected as shown below:

Column 1, line 3, insert

" FIELD OF THE INVENTION

The present invention relates to a joint for connecting tubular beams to form a frame. "

Column 6, line 38, change " dp/dr " to -- dP/dr --

Column 6, line 43, change " dp/dr " to -- dP/dr --

Column 7, line 26, delete " : "

Column 8, line 3, delete " : "

Column 8, line 65, delete " : "

Signed and Sealed this

*Twenty-fourth* Day of *August 1982*

[SEAL]

*Attest:*

GERALD J. MOSSINGHOFF

*Attesting Officer*

*Commissioner of Patents and Trademarks*